US006319610B1

(12) United States Patent
Zimmer

(10) Patent No.: US 6,319,610 B1
(45) Date of Patent: Nov. 20, 2001

(54) GRADED GRAIN SIZE DIAMOND LAYER

(75) Inventor: Jerry W. Zimmer, Saratoga, CA (US)

(73) Assignee: SP³, Inc., Mountain View, CA (US)

( * ) Notice: Subject to any disclaimer, the term of this patent is extended or adjusted under 35 U.S.C. 154(b) by 0 days.

(21) Appl. No.: 09/276,771

(22) Filed: Mar. 25, 1999

Related U.S. Application Data

(62) Division of application No. 08/393,766, filed on Feb. 24, 1995, now Pat. No. 6,063,149.

(51) Int. Cl.[7] ..... B32B 9/00

(52) U.S. Cl. ..... 428/408; 428/212; 428/141; 428/156; 428/325; 428/457; 428/698

(58) Field of Search ..... 428/408, 323, 428/325, 698, 457, 212, 156, 141

(56) References Cited

U.S. PATENT DOCUMENTS

| | | | | |
|---|---|---|---|---|
| 4,171,973 | | 10/1979 | Hara et al. | 75/237 |
| 4,311,490 | * | 1/1982 | Bovenkerk et al. | 51/307 |
| 4,353,953 | * | 10/1982 | Morelock | 428/408 |
| 4,604,106 | | 8/1986 | Hall et al. | 51/293 |
| 4,766,040 | | 8/1988 | Hillert et al. | 428/552 |
| 4,816,286 | | 3/1989 | Hirose | 427/39 |
| 4,842,937 | | 6/1989 | Meyer et al. | 428/408 |
| 5,011,514 | | 4/1991 | Cho et al. | 51/295 |
| 5,024,680 | | 6/1991 | Chen et al. | 51/295 |
| 5,112,649 | | 5/1992 | Bringmann et al. | 427/249 |
| 5,114,696 | | 5/1992 | Purdes | 432/446 |
| 5,135,730 | | 8/1992 | Suzuki et al. | 423/446 |
| 5,135,807 | * | 8/1992 | Ito et al. | 428/408 |
| 5,147,687 | | 9/1992 | Garg et al. | 427/249 |
| 5,160,544 | | 11/1992 | Garg et al. | 118/724 |
| 5,169,676 | * | 12/1992 | Moran et al. | 428/408 |
| 5,178,645 | | 1/1993 | Nakamura et al. | 51/293 |
| 5,200,231 | | 4/1993 | Bachmann et al. | 427/573 |
| 5,236,740 | | 8/1993 | Peters et al. | 427/249 |
| 5,256,206 | | 10/1993 | Anthony et al. | 118/723 |
| 5,270,077 | | 12/1993 | Knemeyer et al. | 427/249 |
| 5,366,522 | | 11/1994 | Nakamura et al. | 51/293 |
| 5,391,422 | * | 2/1995 | Omori et al. | 428/212 |
| 5,425,965 | | 6/1995 | Tamor et al. | 427/249 |
| 5,485,804 | | 1/1996 | Adair et al. | 117/90 |
| 5,507,987 | | 4/1996 | Windischmann | 264/81 |
| 5,523,121 | | 6/1996 | Anthony et al. | 427/249 |
| 5,525,815 | | 6/1996 | Einset | 257/77 |
| 5,567,522 | | 10/1996 | Tanabe et al. | 428/408 |
| 5,571,236 | * | 11/1996 | Takahashi et al. | 72/467 |
| 5,645,617 | * | 7/1997 | Frushour | 51/309 |

FOREIGN PATENT DOCUMENTS

| | | |
|---|---|---|
| 62-256795 | 11/1987 | (JP) . |
| 5-148089 | 6/1993 | (JP) . |

* cited by examiner

*Primary Examiner*—Archene Turner
(74) *Attorney, Agent, or Firm*—Robert Moll

(57) ABSTRACT

The invention relates to diamond coatings and the growth of diamond coatings suitable for tools, wear parts, and the like. The invention produces polycrystalline coatings having progressively finer grain size in the direction of the outer surface, which enhance the wear resistance and finish characteristics of the parts and tools. In one embodiment, chemical vapor deposition grows a first region over a substrate with a plurality of nucleation sites and the first region transitions into polycrystalline diamond grains growing progressively smaller to an average grain size of less than three microns.

9 Claims, 8 Drawing Sheets

Graded Grain Size Diamond Layer

| Standard Diamond Process | Graded Diamond Layer Process Range | Graded Diamond Layer Preferred Values |
|---|---|---|
| 15-80 Torr<br>1-4% $CH_4$ in $H_2$<br>600-900°C | 15-80 Torr<br>1-4% $CH_4$ in $H_2$<br>600-900°C | 35 Torr<br>2% $CH_4$<br>650-750°C |
| 15-80 Torr<br>0.5-3% $CH_4$ in $H_2$<br>700-1000°C | 15-80 Torr<br>1-8% $CH_4$ Ramped at a linearly increasing rate during process.<br>700-1000°C | 25 Torr<br>3-5% Ramped $CH_4$<br>750-850°C |
| N/A | 15-80 Torr<br>3-8% $CH_4$<br>700-1000°C | 25 Torr<br>5% $CH_4$<br>750-850°C |

Figure 4

SURFACE FINISH TESTS

| Test No. | Type of Edge | Coating | Surface Finish ($\mu$ in.) |
|---|---|---|---|
| 1. | Honed | 12 $\mu$m | 82 |
| 2. | Sharp | 12 $\mu$m | 78 |
| 3. | Sharp | 12 $\mu$m GR | 58 |
| 4. | Honed | 12 $\mu$m GR | 65 |
| 5. | Sharp | 22 $\mu$m | 82 |
| 6. | Honed | 12 $\mu$m polished | 70 |
| 7. | Honed | 12 $\mu$m GR and polished | 45 |

GR = Graded Layer.

Figure 5

GRADED GRAIN SIZE DIAMOND LAYER

The present application claims priority and is a divisional of U.S. application Ser. No. 08/393,766, filed on Feb. 24, 1995 now U.S. Pat. No. 6,063,149, which is incorporated herein by reference.

BACKGROUND

The field of the present invention relates generally to diamond coatings for cutting tools and wear parts, and more particularly to a polycrystalline diamond coating including a graded diamond layer having a progressively finer grain size in the direction of the outer surface for providing enhanced wear resistance and smoother finishing characteristics.

There is an increasing demand for harder, more abrasion resistant cutting tools. Recent advances in material science have led to the development and widespread use of extremely hard and abrasive materials such as improved ceramic materials, metal matrix composites, silicated aluminum, graphite composites, fiber reinforced plastics or the like. This has created a heightened demand for abrasion resistant cutting tools which are capable of machining the new materials.

Conventional cemented carbide cutting tools, which are typically coated with a material such as titanium nitride (TiN) or titanium carbide (TiC) or a combination of the two for enhancing performance, are no longer adequate for machining modern abrasive materials. It has been found that diamond cutting tools last at least ten times longer than conventional coated carbide tools. However, conventional diamond tools also cost at least ten times as much as carbide tools. Thus, tool cost is presently a disadvantage of conventional diamond cutting tools.

The hardness and thermal properties of diamond are but two of several characteristics that make diamond useful in a variety of industrial applications. Diamond may be synthesized by high pressure-high temperature (HP-HT) techniques utilizing a catalyst/sintering aid where diamond is the stable phase. This process has been used to form polycrystalline diamond (PCD) compacts which can be bonded or fastened to a supporting body, often of tungsten carbide, to form polycrystalline diamond tools.

A variety of work has been done in this field focusing upon the use of binders and the coating of diamond particles to retain diamond grit and to improve wear resistance. See, e.g., U.S. Pat. Nos. 5,024,680 and 5,011,514, and references discussed therein as examples of conventional methods for improving grit retention in a matrix by metal coating diamond particles. In other conventional methods, layers of binder material are used between diamond and the supporting tool or substrate to improve bonding and adhesion. See U.S. Pat. 4,766,040 ("Hillert") and references discussed therein.

One of the problems in a conventional method of forming a diamond coating over a tool is that adhesion may be hindered due to a thermal expansion mismatch between the supporting tool and the hard, rigid polycrystalline diamond working edge. To overcome this problem, Hillert uses multiple layers of diamond with different levels of a low-melting point binding metal. The composition of the layers is varied such that the thermal expansion of the layers is higher for internal layers near the supporting tool, while the outer working edge is harder and more rigid. Hillert describes that preferably the metal concentration of the polycrystalline diamond body is decreased towards the working surface. Thus, multiple interlayers are used to improve the bonding between a supporting tool and a hard, rigid diamond working edge. The Hillert patent does not teach the use of a fine grained coating to alter the properties of the working edge. The properties of the working edge may be altered to some extent, however, by altering the type and amount of binder used as well as the size of the diamond particles. For instance, U.S. Pat. No. 4,171,973 describes the use of very fine diamond particles with a binder to improve the surface finish of a sintered diamond compact. However, the diamond grains are essentially glued using high levels of a cobalt binder. This has the disadvantage of reducing wear resistance and hardness.

Another disadvantage of polycrystalline diamond tools is that such tools are costly to manufacture. Also, due to high pressure and high temperature fabrication requirements, polycrystalline diamond material must be manufactured as a flat slab of material having a thickness typically 1 mm or more. Thus, polycrystalline diamond slabs are not adaptable to tools having complex shapes such as chip groove inserts, taps and drill bits.

To overcome the foregoing disadvantages and problems of conventional methods of providing a diamond cutting tool, efforts in the industry have focused upon the growth of adherent diamond films at low pressure, where it is metastable. Although low-pressure techniques have been known for decades, improvements in growth rates have made the process a commercially viable alternative to polycrystalline diamond compacts.

Low pressure growth of diamond is accomplished through chemical vapor deposition (CVD). Three types of CVD are typically used for diamond growth, hot filament CVD, plasma torch, and plasma-enhanced CVD (PECVD). A variety of work has been done with all three techniques to improve growth rates, uniformity of the diamond film, reduction of defects and non diamond impurities, and epitaxial growth on diamond or non diamond substrates (S. Lee, D. Minsek, D. Vestyck, and P. Chen, Growth of Diamond from Atomic Hydrogen and a Supersonic Free Jet of Methyl Radicals, *Science,* Vol. 263 at 1596 (Mar. 18, 1994)). The following patents address many of the problems inherent in low pressure growth of diamond: U.S. Pat. No. 5,112,649 (improved filament for longer process duration in hot filament CVD), U.S. Pat. No. 5,270,077 (method of producing flat CVD diamond film primarily for use in electronics), U.S. Pat. No. 5,147,687 (hot filament CVD of multiple diamond layers to provide thick coatings), and U.S. Pat. No. 5,256,206 (CVD of uniform film on irregular shaped objects such as twist drills).

Adequate adhesion of a diamond layer to a substrate or tool also has been an obstacle to the use of diamond films. U.S. Pat. No. 4,842,937 describes a conventional method for providing a polycrystalline diamond coating similar to the method described in Hillert. A plurality of layers are deposited on a cutting tool using CVD or other techniques known in the art. Each successive layer disposed further from the base has a higher modulus of elasticity and a greater diamond constituency than the preceding layer. The outermost layer is polycrystalline diamond. As with Hillert, this layering is used to enable a hard, rigid diamond layer to be used as the working edge.

U.S. Pat. No. 5,236,740, which is hereby incorporated by reference, specifically addresses the problem of coating cemented tungsten carbide substrates with adherent diamond films. Cemented tungsten carbide can be formed into a variety of geometries and has the requisite toughness to be a very desirable substrate for the deposition of adherent diamond films.

Despite these advances in the field of diamond tooling, there are still many problems that have not been adequately addressed. First, conventional CVD diamond tools have a rough surface which is not desirable for fine cutting and machining because of the resulting poor surface finish of the machined workpiece. Polishing of the diamond working edge and similar techniques may be used to smooth the surface of the cutting tool, but this is costly and labor intensive. While grain size may be reduced in polycrystalline diamond compacts, or the growth of diamond may be controlled in CVD processes to some extent, it is desirable to find an inexpensive and effective method to reduce the surface roughness of diamond tools, particularly cemented tungsten carbide tools coated with an adherent diamond film.

Also, what is needed is a method to improve the wear resistance of diamond coated tools. A conventional large grain diamond coating has a naturally rough edge which provides many opportunities for crack formation and propagation which can cause premature tool failure. Preferably, such a method also would reduce the formation and propagation of cracks in the diamond.

What is also needed is a smoother diamond coating to reduce the adhesion of workpiece material to the tool surface during the machining process. A smoother tool advantageously results in a lower amount of friction between the workpiece and the tool. This reduces the transfer of heat and improves the wear rate of the tool.

It is extremely labor intensive to polish a conventional diamond tipped or coated tool, and this would add disproportionately to the cost of such a tool. Also, in a situation wherein the geometry of the tool is complex, it is not practical to polish a diamond coated tool in order to make the tool surface smooth.

SUMMARY

In order to overcome the foregoing and other disadvantages and problems of conventional methods of diamond coating and diamond coated tools, one aspect of the present invention provides a graded diamond layer for any wear coating or application requiring a smooth, hard, long wearing surface. The graded diamond layer includes a first region grown over a conventional substrate having a plurality of nucleation sites.

A first layer of polycrystalline diamond is provided over the nucleation sites in a conventional CVD manner. The grain size of this first diamond region is roughly one half of the thickness of this region. The first region then transitions into a graded layer of polycrystalline diamond wherein the diamond grains become progressively smaller toward the outer surface. At the surface of the coating, that is the surface provided for frictional engagement with a workpiece, the average grain size is substantially less than three microns.

Despite teachings in the prior art that a hard, large grained outermost diamond layer is preferred for maximum wear resistance, it has been found that a fine grained diamond layer nevertheless can improve the surface finishing characteristics of a diamond coated cutting tool without degrading the wear characteristics.

Thus, another aspect of the present invention relates to the use of a hard diamond outer layer including a material with a finer grain size than the underlying diamond tool coating.

It is an advantage of this and other aspects of the present invention that a smooth outer layer of fine grained diamond promotes the even distribution of cutting forces and thereby reduces chipping and wear. It is another advantage that the surface roughness of the tool is reduced, since the finer grain diamond material acts to fill in the interstitial spaces in the underlying irregularly shaped larger grain diamond film.

Another aspect of the present invention relates to the use of a hard, predominantly fine grained diamond outer layer which is highly resistant to wear and enables the diamond coating to wear down evenly to the larger grained material. Surprisingly, according to an aspect of the present invention, it has been found that fine grained diamond can provide a measured wear resistance at the surface equal to 80–90% of the larger grained diamond materials. This aspect of the invention also contradicts conventional techniques which uniformly teach providing an outermost layer of large grained diamond for performing the cutting or polishing interface with a workpiece.

Another aspect of the present invention relates to the use of a hard, fine grained diamond outer layer that reduces the cutting forces between the diamond tool and the workpiece. It is an advantage of this and other aspects of the present invention that the wear rate of a tool coated with the graded diamond layer also is reduced.

Yet another aspect of the present invention relates to the use of a graded diamond layer or diamond like carbon (DLC) layer over a diamond tool to further improve the effect of the surface finish of the workpiece.

Another aspect of the present invention relates to the use of a graded diamond layer to reduce crack formation which is typically encountered in conventional large grain diamond layers.

BRIEF DESCRIPTION OF THE DRAWINGS

The invention will be understood more fully from the detailed description given below and from the accompanying drawings of the preferred embodiments, wherein:

FIG. 4 is a table showing process parameters for making a graded diamond layer in accordance with an aspect of the invention;

FIG. 5 is a table showing surface finish tests which demonstrate the effectiveness of a graded diamond layer in improving surface finish on a machined part according to an aspect of the invention;

DETAILED DESCRIPTION

Figure 1:
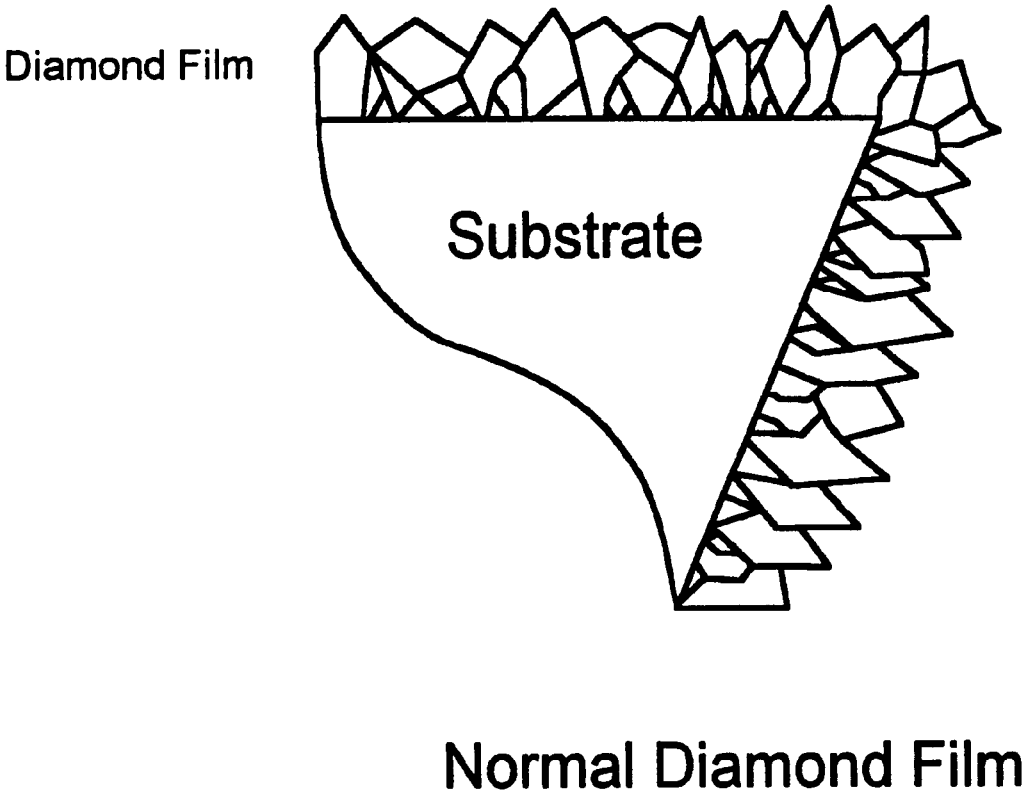
FIG. 1 shows a conventional diamond coating.

In accordance with the teachings of this invention, a novel method is taught for providing grown diamond layers suitable for use as any type of wear coating surface, such as cutting tools. A first step in this novel process creates small particles of diamond on the surface of a substrate which establish the density of diamond crystals which will be grown in one embodiment. The next general step is the main diamond growth process, which utilizes different process conditions from that of the previously described nucleation step.

Furthermore, in accordance with the teachings of this invention, a novel third step is used in order to provide relatively small diamond grain size on the final surface of the grown diamond layer. This is in clear contradistinction to the prior art, which would use the same process conditions throughout the diamond growth step. As previously described, in such prior art processes, the film starts out with relatively small diamond grains which grow together, and once they have grown together the overall grain size of the film gets larger. In other words, grain size increases with increasing thickness of the prior art diamond layer, providing an extremely rough top surface which wears well but does not provide a good surface finish.

In accordance with an aspect of the invention, a very smooth top surface is formed. This top surface can be either a fine grain diamond or diamond like carbon (DLC) layer, depending upon when the process is terminated. DLC is no longer considered diamond due to its very small grain size and thus very smooth top surface. While fine grain material generally wears faster than large grain material, leading the prior art to provide large grained diamond layers to get maximum wear resistance, the teachings of this invention yield small grained diamond at the outer surface and yet which has on the order of 80% to 90% or more of the wear resistance of prior art large grain diamond material. This is substantially greater wear resistance than the small grain diamond material of the prior art and does not exhibit significantly less wear resistance than large grain diamond material, providing an excellent compromise between wear resistance and surface smoothness.

During the growth of diamond crystals, a so called diamond continuum is passed through, whereby carbon bearing gas is used to form desirable diamond, or diamond-like carbon (DLC), and which inherently also forms graphite. This graphite is to be removed, which is the purpose of the atomic hydrogen (when carbon-hydrogen gasses are used), as atomic hydrogen etches graphite significantly faster than it etches DLC or diamond. Thus, during the diamond growth process, graphite is inherently produced and thus desirably removed by controlling the amount of atomic hydrogen. In addition to the well known use of methane in diamond growth, other carbon bearing gases are suitable for providing the carbon necessary for crystal and diamond growth, including acetylene, propane, methanol, isopropanol, where carbon is used as the diamond growing element and hydrogen is used as the graphite etching element.

In fact, other types of gases can be used which etch graphite significantly faster than DLC or diamond, including oxygen, and thus the use of oxygen and the control of the ratio of oxygen to carbon is used in alternative embodiments of the present invention. In such embodiments, acetylene and oxygen or methanol and water are suitable gases for use in the process of this invention.

In accordance with the teachings of this invention, in one embodiment during the process used to grow a synthetic diamond layer, the ratio of diamond forming element with respect to graphite etching element (i.e. the ratio of carbon to hydrogen, when methane ($CH_4$) is used in the growth of diamond layers) in the growing vessel is changed over time in order to change the grain size of diamond layers being grown. In order to make a smaller size diamond grain, it is necessary to increase the ratio of carbon to hydrogen. This is done by adding methane ($CH_4$) or other suitable carbon bearing gases. In this embodiment, the pressure and temperature parameters can remain substantially the same when there is a change of the ratio of carbon to hydrogen, or one or both of pressure or temperature parameters can change within, perhaps, plus or minus 25%, in order to achieve the desired quality and grain size. In general, in accordance with this aspect of the invention, if temperature is increased, diamond grain size becomes larger. If pressure is increased, diamond grain size becomes smaller. It has been found that the level of atomic hydrogen is also somewhat dependent upon the geometry of the system, such as a hot filament reactor. Also, temperature depends upon the distance of the substrate to the torch head, or substrate to filament distance, in the case of a hot filament reactor, or upon the plasma to substrate distance, as in the case of a microwave assisted plasma CVD reactor. Generally, the closer the distance between the energy source and the surface upon which the diamond is to be grown, the greater the temperature. The distance between the target surface and the energy source also determines to some extent the amount of atomic hydrogen in the reaction chamber.

Figure 2:
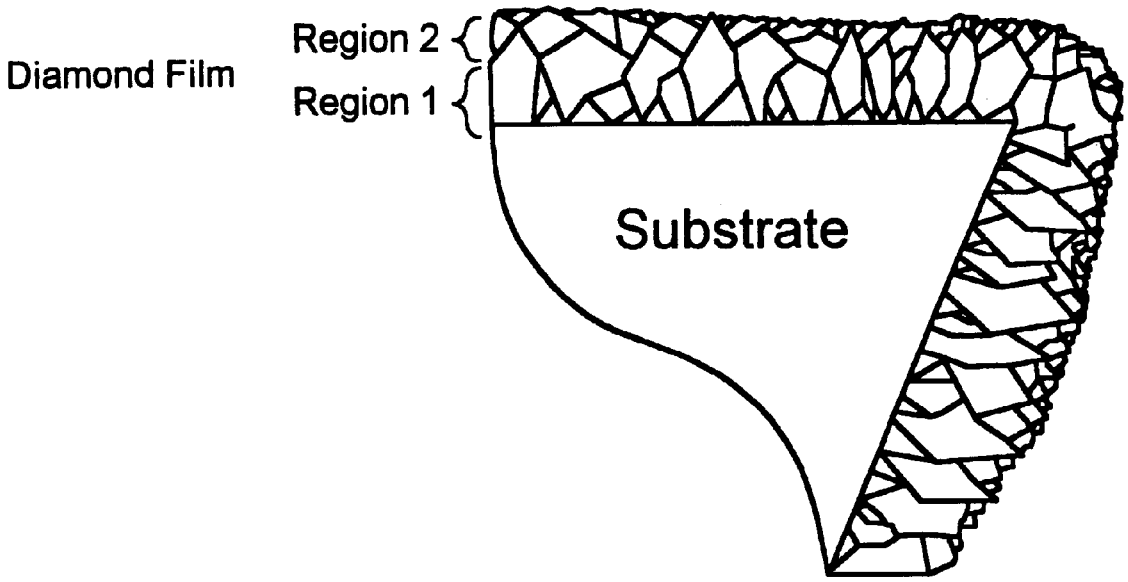
FIG. 2 shows a graded diamond layer according to an aspect of the present invention.
Figure 3:
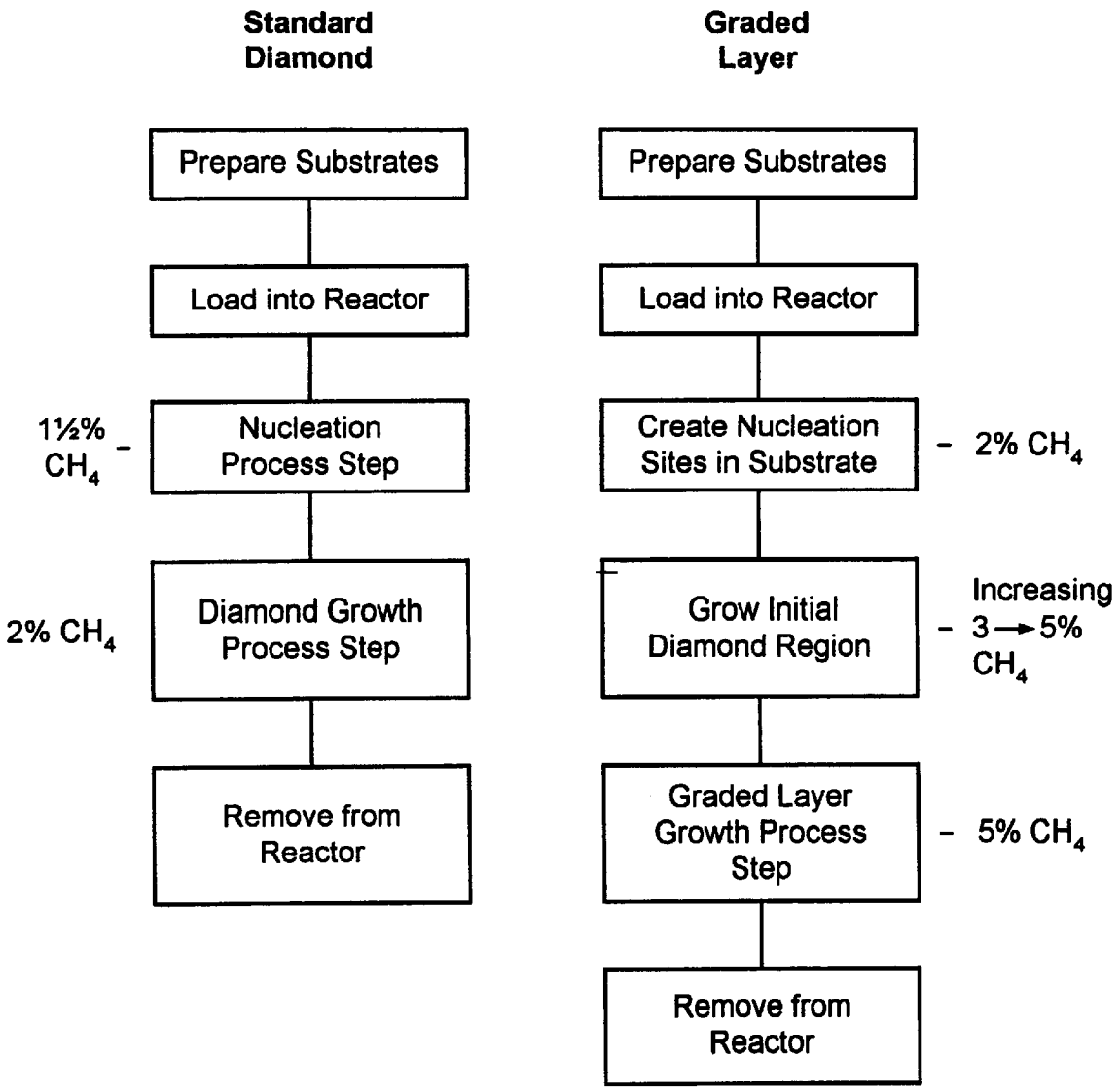
FIG. 3 is a flowchart showing a standard process for creating a conventional CVD diamond layer and a process for creating a graded diamond layer according to an aspect of the present invention.
Figure 6:
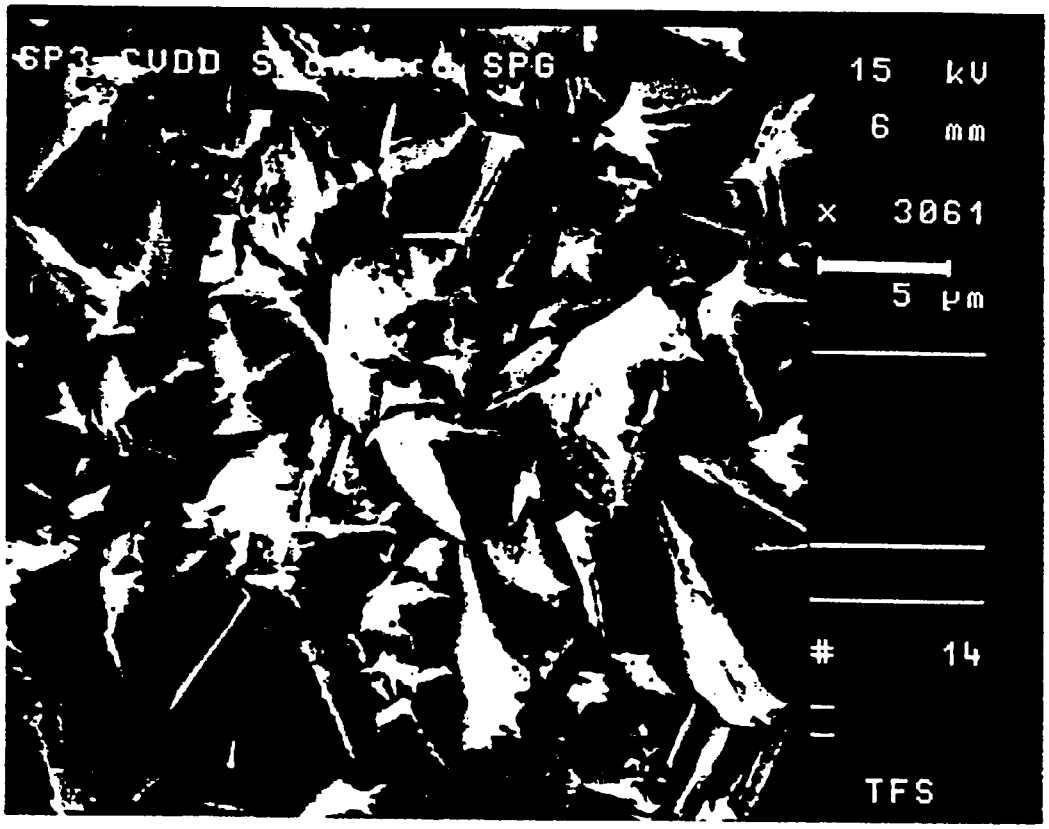
FIG. 6 is a microphotograph showing the surface of a conventional diamond coated cutting tool.
Figure 7:
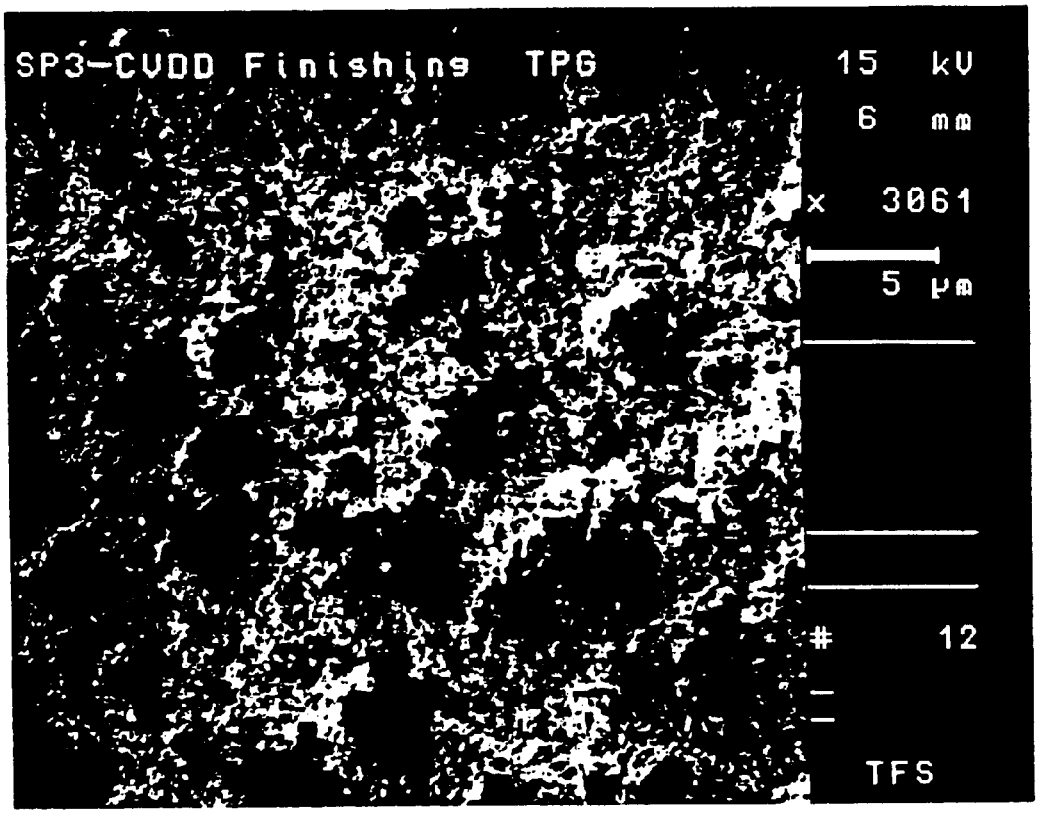
FIG. 7 is a microphotograph showing the surface of a cutting tool coated with a graded diamond layer in accordance with an aspect of the present invention.
Figure 8:
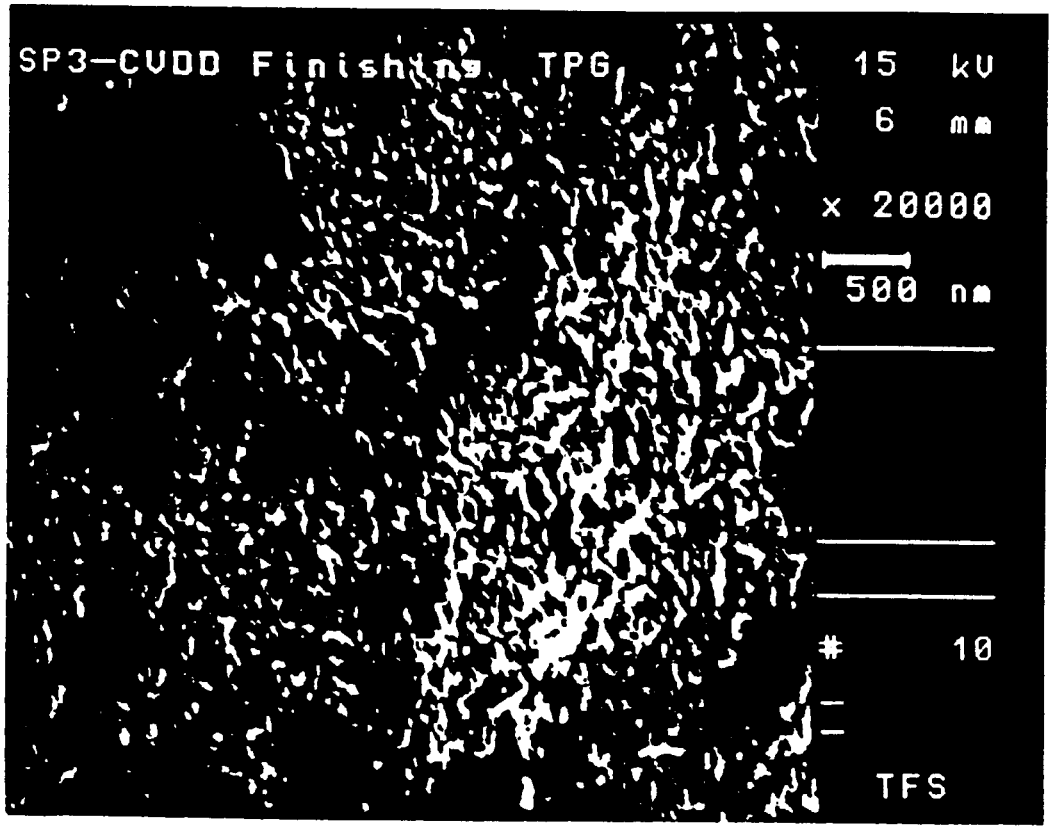
FIG. 8 is an enlargement of the microphotograph of FIG. 7.

In one embodiment of this invention, methane is used, with increasing levels over time, in order to disrupt single crystal diamond growth on the surface of the growing diamond film. Increasing the level of methane prevents diamond crystals from continuing to grow to a large grain size, and thus provides polycrystalline diamond growth of progressively smaller grain size as the film grows. In one embodiment, when small grained diamond is being grown on the surface, the level of methane is approximately two and a half times as dense as earlier in the process. It will be appreciated that the partial pressure of a gas such as methane, may be viewed in terms of density. The larger the partial pressure, the higher the density of the gas. This disruption of the diamond crystal growth by increasing the carbon to hydrogen ratio allows smaller diamond crystals to be grown in interstitial spaces between the larger grains. Thus, as shown in FIG. 2, the interstitial spaces between large diamond grains in Region 1 are filled with medium diamond grains. The interstitial spaces between medium diamond grains and other medium grains or large diamond grains are filled with smaller diamond grains, as shown in Region 2 of FIG. 2, and so on.

In one embodiment of this invention, the level of methane is determined for the small diamond grain size desired on the top surface of the diamond layer being grown. Then, a lower methane level is used during the early stages of the process in order to provide nucleation site and large diamond grains. The level of methane is ramped up over time during the process to that predetermined level which will provide the small grain size desired at the final diamond level. It is important to note that absolute flow rates of gases are irrelevant to this process. What is important is the ratio of active or atomic hydrogen to the amount of carbon. As previously described, appropriate carbon bearing gases other than methane can be used in a similar fashion to create a graded diamond layer.

In another embodiment of this invention, the chamber pressure is determined empirically, which will provide the small diamond grain size desired at the upper level of the diamond layer being grown. Then, a lower chamber pressure is used earlier in the process in order to provide nucleation sites and grow large diamond grains, with the pressure being increased over time during the process to that determined for providing the small diamond grain size desired at the upper levels of the device.

Each of these methods increases the ratio of carbon to atomic hydrogen when it is desired to provide small diamond grain growth. An advantage of varying the level of the methane is that the change in the ratio of carbon to atomic hydrogen is a linear function of the amount of methane, allowing for easy control. An advantage in changing the pressure in the reaction vessel is that the amount of atomic hydrogen at the surface of the structure having diamond growth decreases faster than would be the case with simply increasing the methane content.

Alternative methods for changing the generation rate of atomic hydrogen at the surface of the device where diamond growth is taking place is to decrease the energy being applied to the reaction vessel, such as by changing the filament temperature, or changing the amount of microwave power or other type of energy going into the reaction vessel torch.

In yet another embodiment of the present invention, the effect on atomic hydrogen is controlled by controlling the distance of the substrate upon which diamond is being grown from the source of atomic hydrogen, such as the distance from a filament, the distance to the torch head or flame front, or the distance from the microwave plasma ball to the working surface of the substrate. This distance can be changed, for example, by well known methods for positioning a substrate holder.

The following examples are shown as exemplary of a process of the present invention in which process parameters are changed over time in order to disrupt the large grain diamond crystal growth to thereby provide smaller diamond grains grown within interstitial spaces in order to provide a smoother diamond or DLC layer on the surface of a diamond layer.

FIG. 5 shows data from surface finish tests conducted using a workpiece comprising 6061 T6 aluminum alloy. The cutting tools used comprise TPG-322 sintered tungsten carbide. Some cutting tools or inserts were provided with sharp edges, while other cutting tools were provided with honed edges as shown. The various CVD diamond coatings and treatments are shown. All tests were done at a speed of 2,500 surface feet per minute (sfm), a depth of cut of 0.050 inches, and 0.005 inches per revolution (ipr) feed on a conventional lathe. Good chip breaking was maintained in all tests. Each test consisted of making a 5 inch long cut in a workpiece to be measured for surface finish. The surface finish data were taken on a Tally Surf after calibrating it with Sheffield standards at 20 and 120$\mu$ inch finishes.

The test data show that the graded layer coating (GR) according to an aspect of the invention, is more effective in improving surface finish on a machined part than is polishing a conventional tool surface, as shown by test nos. 1, 4 and 6. For example, in test no. 1, a honed tool with a conventional CVD diamond coating of 12 $\mu$m produces a surface finish measurement of 82$\mu$ inch on the workpiece. In contrast, as shown by test no. 4, a honed tool incorporating a 12 $\mu$m thick graded layer coating according to the present invention, achieves a surface finish measurement of 65$\mu$ inch on the workpiece; an improvement of 17 points or 21%.

Test nos. 2, 3 and 5 indicate that the graded layer coating in accordance with an aspect of the present invention, gives a better surface finish than the conventional coating on a conventional sharp edge tool, regardless of the coating thickness. Finally, test no. 7 shows that a tool incorporating a polished graded layer coating in accordance with an aspect of the invention appears to offer the best overall performance.

As shown in test nos. 2, 3 and 5, a sharp edged tool incorporating a graded layer in accordance with an aspect of the invention, achieves as much as a 20 point improvement in the surface finish of a workpiece in comparison to a conventional sharp edged tool. The best overall performance is shown in test no. 7 wherein a honed edge tool incorporating a polished graded layer, in accordance with an aspect of the present invention, achieves a surface finish measurement of 45$\mu$ inches on the finished workpiece.

EXAMPLE I

Reactor Type: Hot Filament
Manufacturer: Any suitable hot filament reactor similar to the DIAMONEX hot filament CVD reactor described in U.S. Pat. No. No. 5,160,544.
Reactor Energy Type: Hot Filament
Distance from filament to substrate: 1.5 cm (can be varied to increase temperature)

| | Operation | Preferred |
|---|---|---|
| Step 1. | Nucleation Site Phase (optional) | |
| | 600–900° C. temperature of substrate | (750° C.) |
| | 1–4% $CH_4$ flow rate | (1.5% $CH_4$) |
| | 15–80 torr vessel pressure | (30 Torr) |
| | 10–120 min. time | (30 min) |
| | 1800–2300° C. filament temp (depends upon time; e.g.,) | (2000° C. for 30 min.) |
| Step 2. | Large Grain Diamond Growth-Initial Parameters | |
| | 700–1000° C. temperature of substrate | (850° C.) |
| | 1–4% $CH_4$ initial condition | (1.5%) |
| | 4–8% $CH_4$ final condition | (5%) |
| | 15–80 torr vessel pressure | (20 Torr) |
| | 3–25 hrs time | (10 hrs) |
| | Filament Temps 2100–2700° C. | (2300° C. for 10 hrs) |
| Step 3. | Small Grain Diamond or DLC Growth | |
| | 700–1000° C. temperature of substrate (depends upon two) | (900° C.) |
| | 3–8% $CH_4$ flow rate | (5% $CH_4$) |
| | 15–80 torr vessel pressure | (25 torr) |
| | 0–5 hrs. time | (4 hrs) |

EXAMPLE II

Reactor Type: Microwave Assisted Plasma CVD
Manufacturer: ASTEX, Model No. PDS 18 or equivalent
Reactor Energy Type: microwave generated plasma
Reactor Energy: 5 kW
Distance from plasma to substrate: 1 cm (variable, depending on temperature)

| | Operational Range | Preferred |
|---|---|---|
| Step 1. | Nucleation Site Phase (optional) | |
| | 650–750° C. temperature of substrate | (750° C.) |
| | 2% $CH_4$ flow rate | (2% $CH_4$) |
| | 20–100 torr vessel pressure | (80 Torr) |
| | 10–100 min. time | (30 min.) |
| Step 2. | Large Grain Diamond Growth-Initial Parameters | |
| | 750–850° C. temperature of substrate | (800° C.) |
| | 3–5% $CH_4$ initial condition | (5% $CH_4$) |
| | 5–9% $CH_4$ final condition | (9% $CH_4$) |
| | 20–100 torr vessel pressure | (65 Torr) |

-continued

| | Operational Range | Preferred |
|---|---|---|
| | 2–15 hrs. time | (5 hrs.) |
| Step 3. | Small Grain Diamond or DLC Growth | |
| | 750–850° C. temperature of substrate | (800° C.) |
| | 5–10% $CH_4$ flow rate | (9% $CH_4$) |
| | 20–100 torr vessel pressure | (65 torr) |
| | 3–18 hrs. time | (7 hrs) |

All publications and patent applications mentioned in this specification are herein incorporated by reference to the same extent as if each individual publication or patent application was specifically and individually indicated to be incorporated by reference.

While the invention has been described in connection with what are presently considered to be the most practical and preferred embodiments, it is to be understood that the invention is not limited to the disclosed embodiments, but on the contrary is intended to cover various modifications and equivalent arrangements included within the spirit and scope of the appended claims. For example, other types of gases can be used to control the ratio of the diamond forming element with respect to the graphite etching element and thereby change the grain size of diamond layers being grown. Therefore, persons of ordinary skill in this field are to understand that all such equivalent arrangements are to be included within the scope of the following claims.

What is claimed is:

1. A graded diamond CVD layer grown over a substrate for a wear coating application requiring a smooth hard, long wearing surface comprising:

a substrate having a plurality of nucleation sites for diamond growth;

a first layer of polycrystalline diamond provided on said nucleation sites, wherein said nucleation sites cover substantially all of said substrate, said diamond having a grain size roughly one half of the thickness of said first layer; and a graded diamond layer having an interface surface with said first layer and a wear surface provided over said first layer wherein the graded diamond layer is characterized by progressively smaller grains of diamond as grown in the direction toward said wear surface layer.

2. A graded diamond CVD layer grown over a substrate according to claim 1 wherein said layer of progressively smaller grains of diamond are grown and culminate in the wear surface wherein the crystals of diamond have a grain size of less than 3 microns.

3. A graded diamond CVD layer grown over a substrate comprising:

a substrate suitable for diamond growth;

a first region of diamond overlying substantially all of said substrate, said diamond including crystals characterized by an average grain size substantially equal to one half of the thickness of said first region; and a graded diamond layer characterized by progressively finer grained diamond crystals having an outer surface and an inner interface with said first region wherein said graded diamond layer at said interface has a grain size substantially equal to the grain size of the first region and comprises progressively smaller grained diamond crystals grown and culminating in a fine grained outer surface.

4. A graded diamond CVD layer grown over a substrate according to claim 3 wherein said substrate comprises a material selected from the group consisting of carbide compacts and refractory metals.

5. A graded diamond CVD layer grown over a substrate according to claim 3 wherein said substrate comprises a carbide forming material.

6. A graded diamond CVD layer grown on a substrate according to claim 3 wherein said substrate comprises tungsten carbide.

7. A graded diamond CVD layer grown over a substrate comprising:

a first region of diamond provided over substantially all of said substrate to a predetermined thickness characterized by diamond crystals having an average grain size equal to one half of the thickness of said region; and a graded diamond layer provided over said first region characterized by diamond crystals having a progressively finer grain size as grown culminating in an average grain size substantially less than 3 microns.

8. A graded diamond CVD layer grown over a substrate having a smooth outer surface characterized by a surface roughness of less than 3 microns comprising:

a substrate having nucleation sites sufficient to support diamond growth over substantially all of said substrate; and a diamond layer provided over said substrate and having an outer surface characterized by a surface roughness less than 10% of the thickness of said layer, wherein said diamond layer is characterized by progressively smaller grain material as grown in the direction of said outer surface.

9. A graduated diamond CVD layer grown over a substrate comprising:

a substrate having sufficient nucleation sites over substantially all of said substrate to support diamond growth; and a graduated diamond provided over said substrate and having an outer surface, said graduated diamond layer characterized by diamond crystals of progressively finer grained material as grown in the direction of said outer surface such that the grain size of said diamond crystals at said outer surface is less than or equal to 10% of the thickness of said layer from said substrate to said outer surface.

* * * * *